US006533246B1

(12) United States Patent
Hulligan

(10) Patent No.: US 6,533,246 B1
(45) Date of Patent: Mar. 18, 2003

(54) SHOE CLAMP

(76) Inventor: Jeffrey A. Hulligan, 26810 Russell Rd., Bay Village, OH (US) 44140

( * ) Notice: Subject to any disclaimer, the term of this patent is extended or adjusted under 35 U.S.C. 154(b) by 76 days.

(21) Appl. No.: 09/706,395

(22) Filed: Nov. 6, 2000

Related U.S. Application Data

(60) Provisional application No. 60/170,572, filed on Dec. 13, 1999.

(51) Int. Cl.[7] ..... B66F 7/26

(52) U.S. Cl. ..... 254/45; 254/902; 254/43; 254/37; 254/249; 228/49.3; 33/412

(58) Field of Search ..... 269/45, 902, 43, 269/37, 249, 287, 296, 71, 152; 29/272; 228/49.1, 49.3, 493, 99; 33/412; 267/246

(56) References Cited

U.S. PATENT DOCUMENTS

| | | | | | |
|---|---|---|---|---|---|
| 762,994 | A | * | 6/1904 | Fishering | 144/290 |
| 1,793,561 | A | * | 2/1931 | Schmieder | 269/93 |
| 2,308,340 | A | * | 1/1943 | Newlon | 113/102 |
| 2,888,052 | A | * | 5/1959 | Reason | 144/290 |
| 3,596,898 | A | * | 8/1971 | Hiburn | 269/43 |
| 3,941,364 | A | * | 3/1976 | Hjelm | 269/156 |
| 4,195,828 | A | * | 4/1980 | Peterson | 269/43 |
| 4,232,856 | A | * | 11/1980 | Eichfeld | 269/93 |
| 4,717,131 | A | * | 1/1988 | Dugas | 269/41 |
| 4,779,857 | A | * | 10/1988 | Maund | 269/71 |
| 4,843,702 | A | * | 7/1989 | Charest | 29/240 |
| 4,867,427 | A | * | 9/1989 | Cunningham | 269/88 |
| 4,919,408 | A | * | 4/1990 | Muir | 269/296 |
| 5,135,209 | A | * | 8/1992 | Penny | 269/249 |
| 5,181,702 | A | * | 1/1993 | Pettigrew | 269/93 |
| 5,573,229 | A | * | 11/1996 | Lycan | 269/49 |
| 6,161,296 | A | * | 12/2000 | Davio | 33/412 |
| 6,349,869 | B1 | * | 2/2002 | McBee | 228/49.3 |

OTHER PUBLICATIONS

Copy of brochure titled *Bessey® Specialty Clamps*, one page, undated.

Copy of brochure titled *Strong Hand™ Sliding Arm Clamps*, pp. 2 and 5, undated.

Copy of brochure titled *Bessey® Heat–Treated Steel Clamps*, pp. 3 and 4, undated.

* cited by examiner

*Primary Examiner*—Joseph J. Hail, III
*Assistant Examiner*—Daniel Shanley
(74) *Attorney, Agent, or Firm*—Fay, Sharpe, Fagan, Minnich & McKee

(57) ABSTRACT

A clamping apparatus is provided with a shoe mountable on a work surface, and a clamp having a foot adapted for removable engagement with the shoe. Also provided is a method of clamping a workpiece in a fixed location with respect to a work surface including mounting a shoe on the work surface, providing a clamp with a foot and a clamping head, where the foot is adapted for removable engagement with the shoe, engaging the shoe and the foot, and clamping the workpiece between the clamping head and the work surface.

22 Claims, 6 Drawing Sheets

SHOE CLAMP

This application claims the benefit of copending provisional Application Serial No. 60/170,572, filed on Dec. 13, 1999.

The present invention relates to the art of clamping and more particularly to a shoe clamp for holding a workpiece in a fixed location during the performance of a welding operation.

BACKGROUND OF THE INVENTION

A typical welding station includes a welding table and clamps or fixtures for holding workpieces in a fixed location with respect to the welding table. Once the position of the workpiece or workpieces are so fixed, a welding operation can be performed thereon. When similar weld operations are performed on a large number of workpieces or parts, a special purpose clamp or fixture can be constructed for the particular parts and welding operation. When smaller quantity operations are required, such custom clamping fixtures are impractical. Thus, where a multitude of different, small piece count welding operations are to be performed, a low cost clamping system or device is desirable which can be easily adapted to different clamping tasks. Common C-clamps are adaptable to many different applications, but are limited to locations near the edge of a welding table. Acorn tables containing a grid array of vertical holes provide for variable clamping configurations when used with commercially available clamps. Clamps may be selectively mounted to an acorn table using one or more of the holes to achieve many different workpiece orientations and positions. Unlike C-clamps used with ordinary workbenches, acorn tables and associated clamps allow the interior of the table to be used for clamping. However, acorn tables are costly. In addition, existing clamping arrangements such as custom fixture tables and acorn tables do not allow for ease of storage. In many manufacturing situations, once a certain workpiece clamping setup has been achieved, it is desirable to store the setup until another batch of a particular part is to be run again. Custom clamping fixtures, if permanently mounted to a welding table, are often unwieldy or clumsy, due to the added protrusion from an otherwise flat table, as well as to the added weight. This creates problems in storing a clamping setup. Similarly, acorn tables with one or more clamps fixed in specific locations can be stored, but the clamps protruding from the top and perhaps the bottom of the table require extra storage space and are sometimes subjected to damage during movement. Moreover, the clamps attached to such stored acorn tables are unavailable for use with other tables or fixtures. Consequently, there remains a need for a clamping apparatus or system which provides easily reconfigurable, cost effective clamping of welding operation workpieces to a welding table or other work surface which can be easily stored while preserving specific clamping configurations, which occupies only slightly more storage space than the table itself, and which allows individual clamps to be used apart from the clamping configuration.

SUMMARY OF THE INVENTION

In accordance with the present invention, there is provided a shoe clamp for holding a workpiece in a fixed location for the performance of a welding operation. More particularly, and in accordance with the principal aspect of the invention, there is provided a clamping apparatus including a clamp with a foot removably engaging a shoe which itself is mounted to a welding table or other work surface. In this regard, the shoe may be positioned in a specific location on a welding table alone or in combination with other clamps, to provide a specific clamping setup or configuration. Such a configuration can achieve the functional equivalence of a special purpose fixture because the shoe or shoes may be located anywhere on the work surface. With one or more such shoes attached to a welding table, the associated clamps may be slidingly engaged in corresponding shoes and adjusted so as to clamp one or more workpieces being welded. When a different setup is needed, such as for a different part of welding operation, the clamps may be removed or slidingly disengaged from the shoes and the table. The welding table, complete with attached shoes, can be stored. In this regard, the clamping configuration is saved because the shoes are precisely located on the welding table. Furthermore, the table is easily stored because it does not include the lengthy protrusions of the clamps, nor the weight of the clamps. This invention also allows the clamps to be utilized apart from the stored welding table. The clamps can be engaged with other shoes mounted onto other tables or fixtures. The shoes themselves are inexpensive to construct, add little weight to the welding tables, and are themselves reusable. The shoes, moreover, can be manufactured from a weldable material, making them easily attachable to a welding table or even to a workpiece by welding. A user can thus have many inexpensive, reconfigurable shoes mounted on various fixtures or welding tables, and a relatively small number of clamps with feet for engaging the shoes.

In accordance with another aspect of the invention, there is provided a clamp foot which itself can be welded to a welding table. This allows attachment of a clamp to a welding work surface for use in a given location, even in the center of a welding table, and where no holes are provided in the table. Such a clamp foot can be fashioned to engage with a shoe as described above if desired, and to alternatively be weldable to a welding work surface. This allows a user to, for example, utilize a shoe clamp for high quantity clamping configurations, and a quick foot clamping setup for one-time or small volume jobs. Where a foot or shoe has been welded to a welding table surface, the weld material can be ground away from the shoe or foot. The foot or shoe is then reusable.

In accordance with still another aspect of the present invention, the foot can be removably mountable to the base of the clamp. In this regard, the foot can be easily attached to any of a number of commercially available industrial clamps having standard base dimensions for use with the above mentioned shoes in a shoe clamp arrangement, or without such a shoe in a foot clamping arrangement. This allows easy adaptation of many existing clamps using a simple, low cost foot, attachable to the clamp base using, as an example, screws or other known fastening techniques.

In accordance with another aspect of the present invention, there is provided a method of clamping a workpiece to a welding table or other work surface. The method includes attaching a shoe to the table or work surface, providing a clamp with a foot adapted to engage with the shoe and a clamping head, engaging the foot with the shoe, thereby securing the clamp to the table or work surface, and clamping the workpiece between the clamping head and the work surface.

It is accordingly a primary object of the present invention to provide an improved clamping apparatus and method for clamping a workpiece to a welding table or other work surface to thereby hold the workpiece in a fixed location with respect to the work surface during a welding operation.

It is another object of the present invention to provide a clamping apparatus of the type described above which is easily adaptable to many different clamping configurations.

It is yet another object of the present invention to provide a clamping apparatus of the type described above which is usable in the interior of the welding table or other work surface.

It is still another object of the present invention to provide a clamping apparatus of the type described above which reduces the costs associated with clamping workpieces for welding.

It is yet another object of the present invention to provide a clamping apparatus of the type described above which allows a relatively small number of clamps to be reconfigured in a short time to form a large number of different clamping configurations.

It is still yet another object of the present invention to provide a clamping apparatus of the type described above which allows storage of a welding table clamping configuration with the clamps removed.

BRIEF DESCRIPTION OF THE DRAWINGS

The foregoing and other objects and advantages will become apparent from the following description of several preferred embodiments of the present invention illustrated in the accompanying drawings in which.

DESCRIPTION OF A PREFERRED EMBODIMENT

Figure 2:
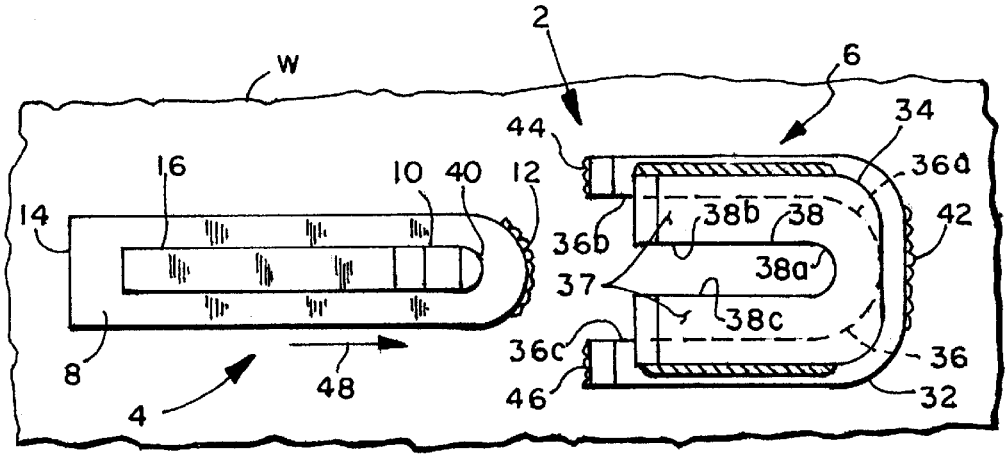
FIG. 2 is a plan view of the clamping apparatus shown in FIG. 1.
Figure 1:
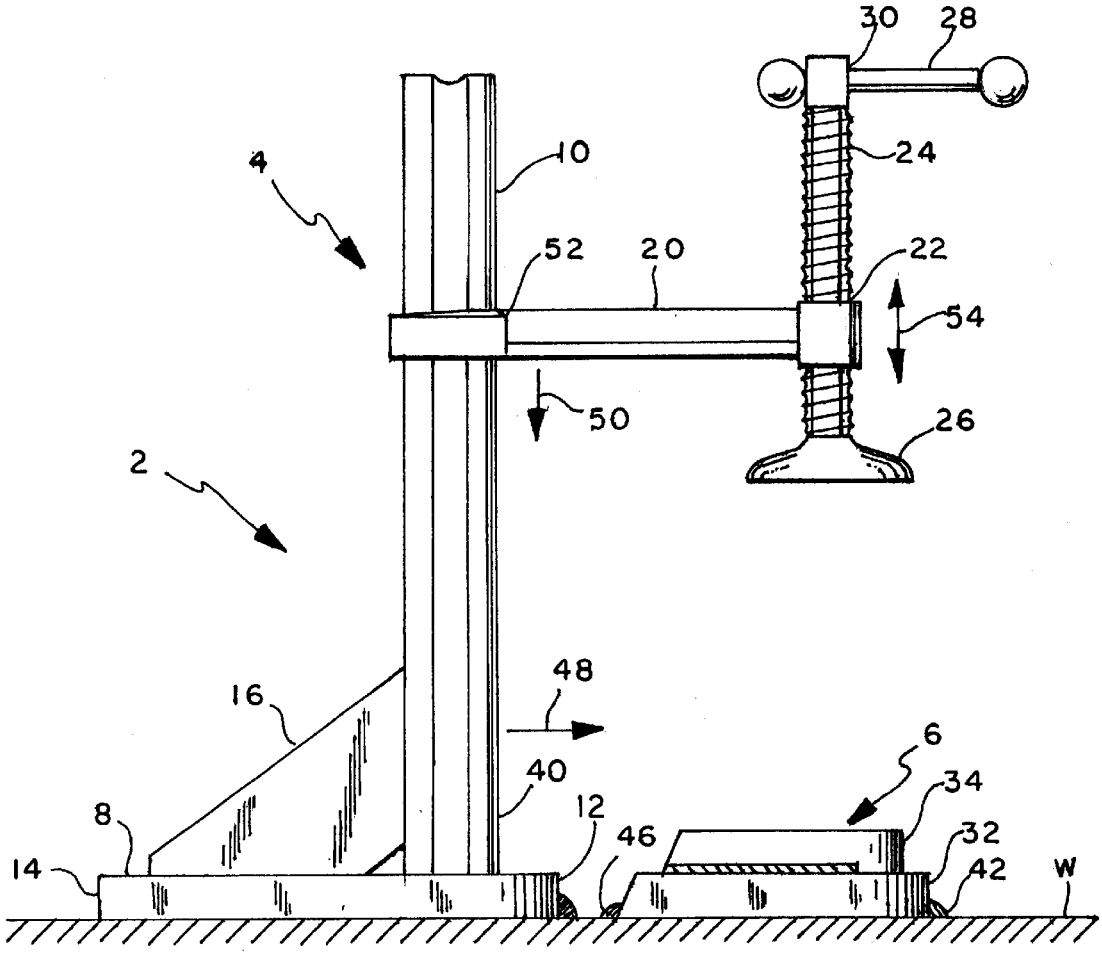
FIG. 1 is a side elevation view of one embodiment of a clamping apparatus in accordance with the present invention showing a clamp and a shoe disengaged.
Figure 14:
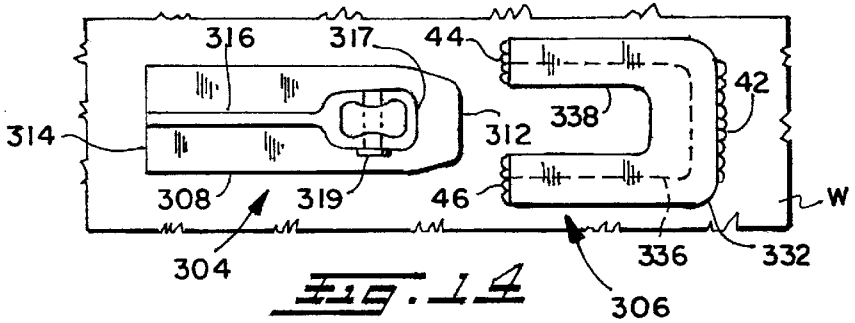
FIG. 14 is a plan view of the clamping apparatus shown in FIG. 13.
Figure 13:
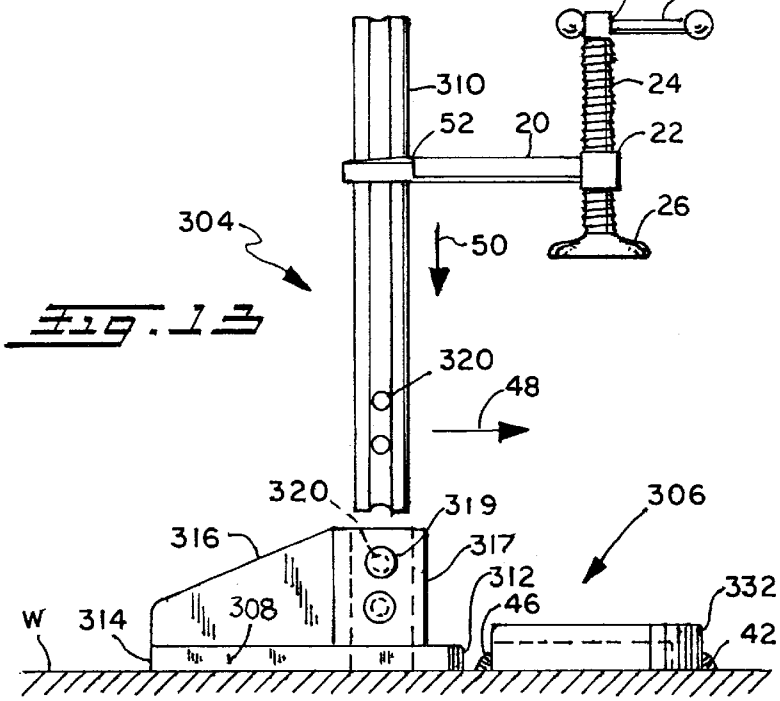
FIG. 13 is a side elevation view of another embodiment of a clamping apparatus in accordance with the present invention showing a clamp and a shoe disengaged.

Referring now to the drawings, wherein the showings are for the purpose of illustrating a preferred embodiment of the present invention only, and not for the purpose of limiting the same, FIGS. 1, 2, 5, and 6 show one embodiment of clamping apparatus 2 including a clamp 4 and a shoe 6 for clamping a workpiece, not shown, in a fixed position with respect to a work surface W, such as a welding table. The clamp 4 includes a foot 8 supporting a vertical base 10. The foot 8 has a front end 12 and a rear end 14. A gusset or brace 16 provides support to base 10 during clamping. An arm 20 extends horizontally outwardly from the base 10 and includes a threaded hole 22 for engaging a threaded screw 24 providing vertical adjustment of the position of a clamp head 26 with respect to the work surface W. Vertical adjustment of the clamp head 26 is accomplished by manipulating a handle 28 extending through a horizontal hole 30 at the upper end of screw 24, in order to rotate the screw 24 and thereby raise or lower the clamp head 26. The shoe 6 includes a U-shaped positioning member 32 and a U-shaped holding member 34 mounted onto the top of the positioning member 32. Positioning member 32 defines the closed end of a recess 36 for interengaging with the front end 12 of foot 8, and the holding member 34 provides an inner slot 38 for receiving the front end 40 of base 10. The U-shaped positioning member 32 and the U-shaped holding member 34 are shown in FIGS. 1 and 2 as welded from two members, but can be constructed as a unitary structure as by casting, as shown in FIGS. 13 and 14.

Figure 3:
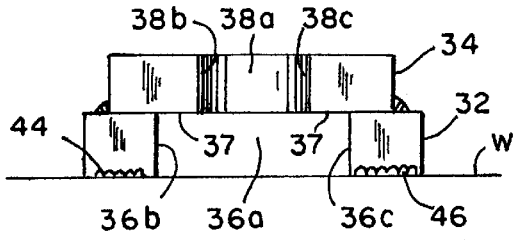
FIG. 3 is a rear elevation view of the shoe as shown in FIG. 2.
Figure 4:
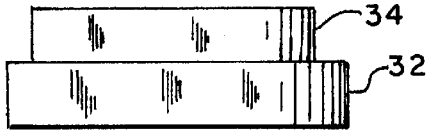
FIG. 4 is a front elevation view of the shoe as shown in FIG. 2.

The inner slot 38 is defined by a holding member front wall 38*a*, a holding member first side wall 38*b*, and a holding member second side wall 38*c*. The holding member first side wall 38*b* and the holding member second side wall 38*c* are parallel to one another and relatively close together. The recess 36 is below the inner slot 38. The recess 36 is defined by a positioning member front wall 36*a*, a positioning member first side wall 36*b*, and a positioning member second side wall 36*c*. The positioning member side walls 36*b*, 36*c* are parallel to one another and spaced apart a distance greater than the distance between the holding member side walls 38*b*, 38*c*. Thus, the recess 36 will retain a structure having a width greater than the inner slot 38, as shown in FIG. 3.

The holding member first side wall 38*b*, the holding member second side wall 38*c*, and the holding member front wall 38*a* have a flange 37 on the inward side. The flange 37, the positioning member front wall 36*a*, the positioning member first side wall 36*b*, and the positioning member second side wall 36*c* form the recess 36 below the holding member 34 for interengaging with the foot 8, as shown in FIG. 3.

Figure 6:
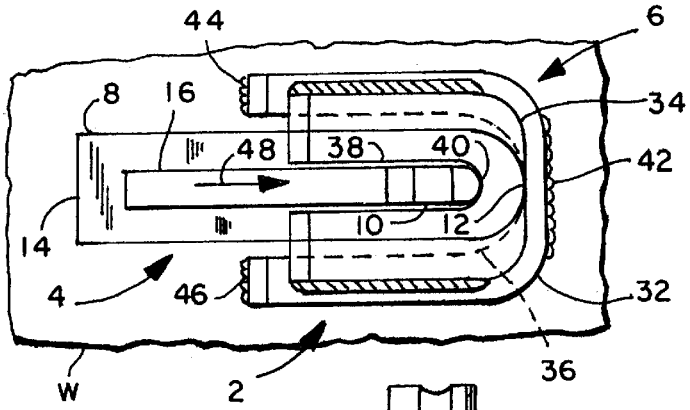
FIG. 6 is a plan view of the clamping apparatus as shown in FIG. 5.
Figure 5:
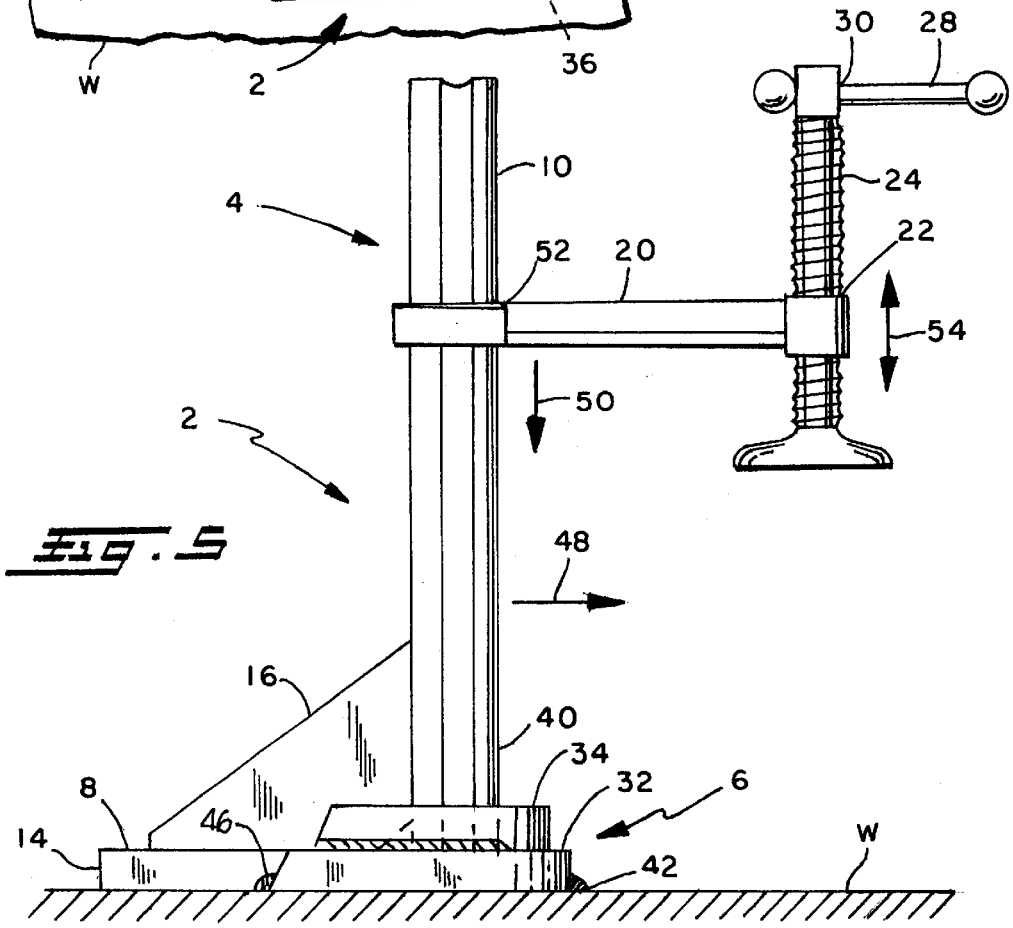
FIG. 5 is a side elevation view of the clamping apparatus as shown in FIGS. 1 and 2 showing the clamp and the shoe engaged.
Figure 8:
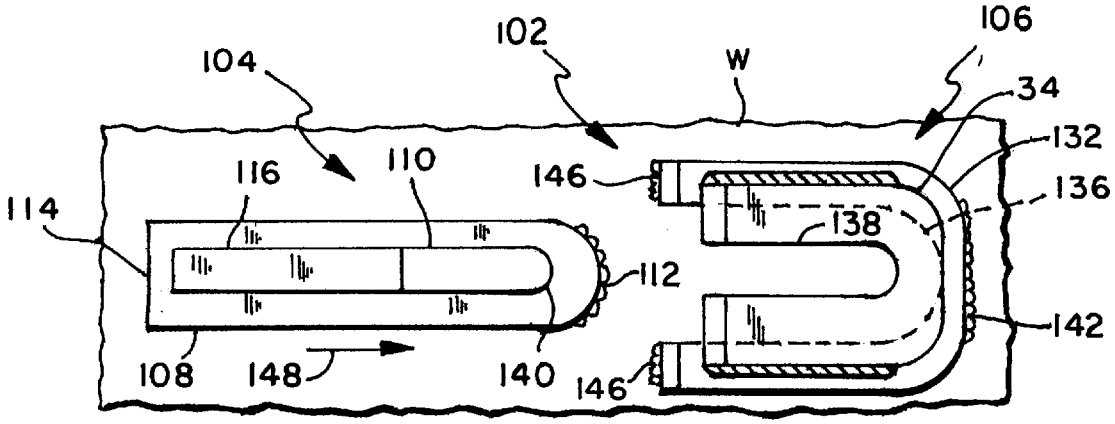
FIG. 8 is a plan view of the clamping apparatus shown in FIG. 7.
Figure 7:
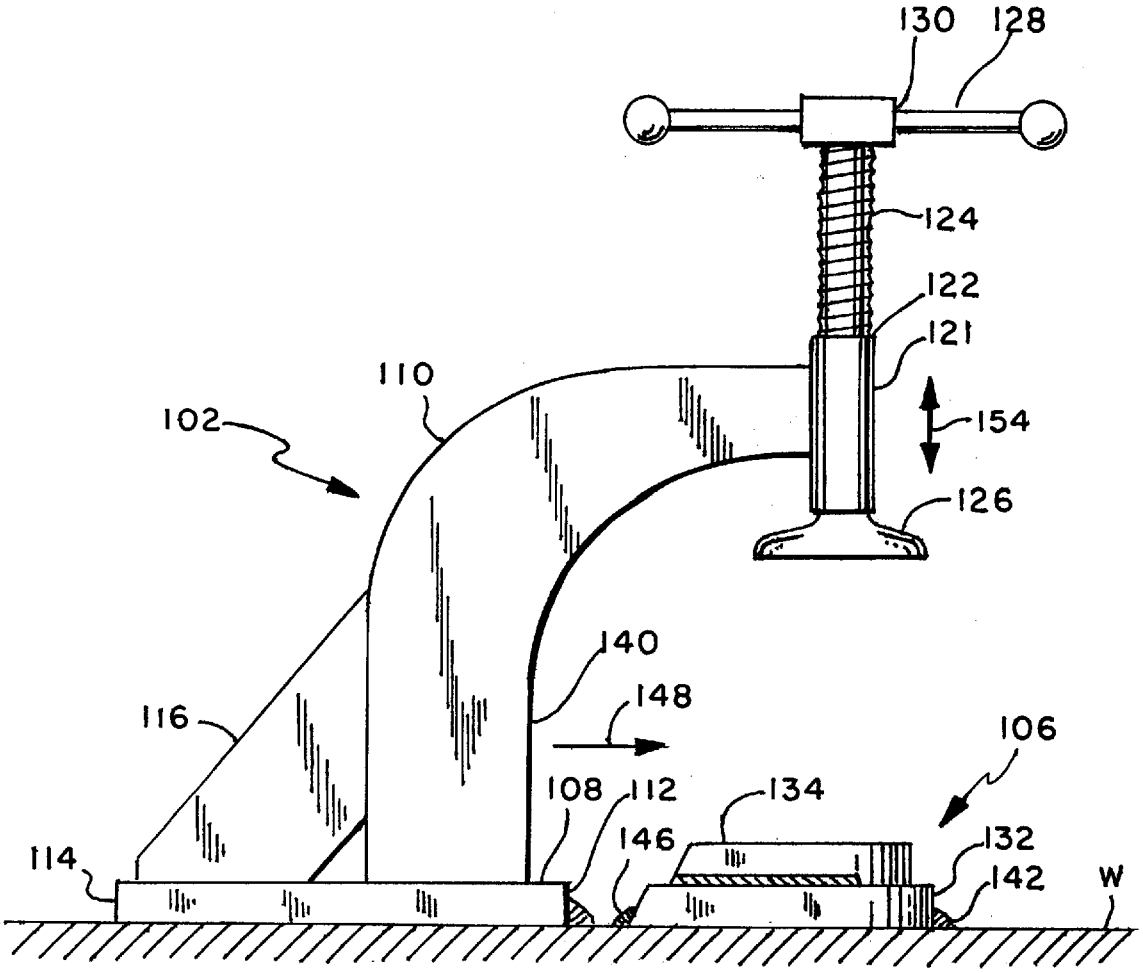
FIG. 7 is a side elevation view of another embodiment of a clamping apparatus in accordance with the present invention shown with a clamp and a shoe disengaged.
Figure 10:
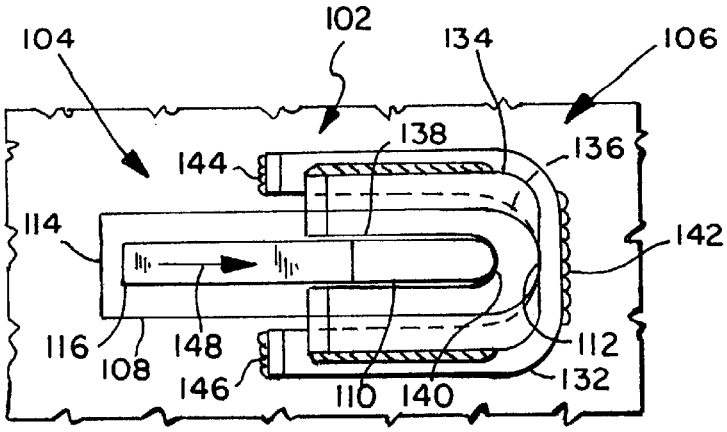
FIG. 10 is a plan view of the clamping apparatus shown in FIG. 9.
Figure 9:
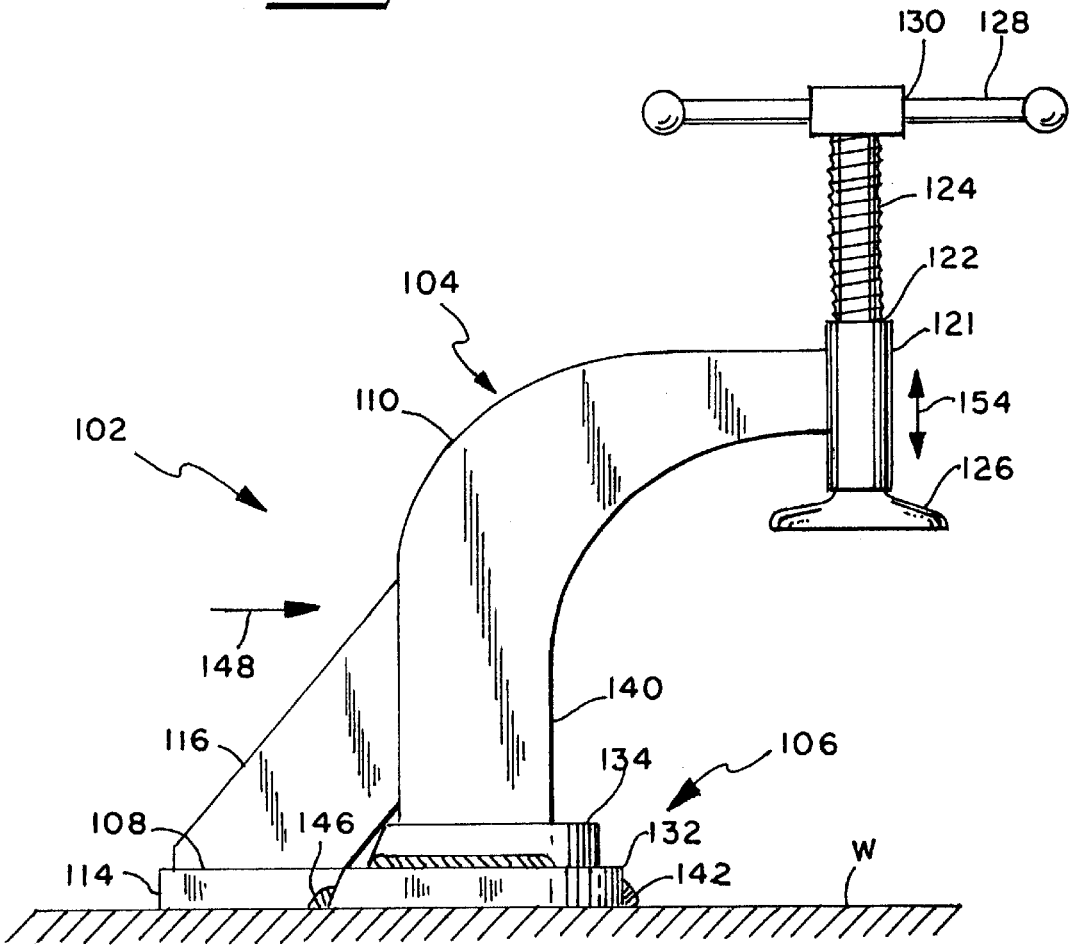
FIG. 9 is a side elevation view of the clamping apparatus shown in FIGS. 7 and 8 wherein the clamp and shoe are engaged.

The positioning member 32 is shown welded to the work surface W at front end 42 and rear ends 44 and 46, respectively. With shoe 6 thus mounted on the work surface W, the clamp 4 may be slidingly engaged with the shoe 6 in a direction shown by arrow 48 until one or both of front ends 12 and/or 40 engage with the closed ends of recess 36 and/or inner slot 38, respectively. With foot 8 thus seated in shoe 6, the position of the clamp 4 is established with respect to work surface W, thereby allowing clamping of workpieces, not shown, between the clamp head 26 and work surface W at a known fixed position determined by the location of the shoe 6 as shown in FIGS. 5 and 6.

Coarse adjustment of the vertical height of clamp head 26 may be accomplished by positioning a workpiece, not shown, under the clamp head 26, then lowering the arm 20 in a direction shown by arrow 50. Arm 20 includes a collar 52 slidingly engaging around the base 10, thus providing fast coarse adjustment of the vertical height of the clamp head 26. Fine adjustment of the height of head 26 is accomplished by rotating the screw 24 using the handle 28 to raise or lower the head 26 in the direction shown by arrow 54. When a clamped workpiece is to be unclamped, the clamp head 26 is raised slightly using handle 28 and screw 24, after which the user can simply slide the arm 20 upwardly to further release clamp head 26 from the workpiece, not shown. If the workpiece needs to be raised from work surface W, the entire clamp 4 can then be slidingly disengaged from the shoe 6 in a direction opposition that of arrow 48. Should a welding table including work surface W need to be stored, the clamp 4 can be so disengaged from the shoe 6. This allows storage of the work surface W including one or more attached shoes 6 which maintain the clamping configuration for later use, while allowing use elsewhere of the clamp 4 in other such arrangements on different work surfaces, not shown. Moreover, different shoes 6 may be positioned at different locations along work surface W to establish clamping configurations for various different welding operations on a single work surface W. In this regard, a sequence of, for example, three different welding operations to be performed sequentially on workpieces, not shown, may be established on three different areas of work surface W by positioning multiple shoes 6 appropriately. As a workpiece progresses from one welding operation to the next, clamps 4 may be moved from one shoe to another, thus allowing the same clamps to be used for all welding operations with minimal setup time between operations.

FIGS. 7, 8, 9, and 10 illustrate another embodiment of a clamping apparatus 102 including a clamp 104 and a shoe 106. As with the previous embodiment, the clamp 104 includes a foot 108 with a front end 112 and a rear end 114, as well as a gusset or brace 116. Foot 108 supports a curved base 1O extending upwardly from the foot 108 and horizontally outwardly to a threaded collar 121 having a threaded hole 122 engaging with a threaded screw 124 allowing vertical adjustment of a clamp head 126 in a direction shown by arrow 154 by rotating the screw 124 using a handle 128 which is engaged with a horizontal hole 130 at the upper end of the screw 124. The shoe 106 includes a U-shaped positioning member 132 defining a recess 136, as well as a U-shaped holding member 134, defining an inner slot 138. Recess 136 and inner slot 138 are dimensioned so as to engage with one or both of the front end 112 of the foot 108 and/or the front end 140 of the base 110 in similar fashion to that of the embodiment shown in FIGS. 1, 2, 5, and 6. The shoe 106 is welded to the work surface W at the front end 142 and rear ends 144 and 146, respectively, of the positioning member 132. The clamp 104 may then be slidingly engaged with the shoe 106 in a direction shown by arrow 148. Because the curve shaped base 110 establishes a fixed vertical position of the collar 121, both coarse and fine vertical adjustment of clamp head 126 are achieved by rotation of the screw 124 using the handle 128 in order to clamp the workpiece, not shown, between the clamp head 126 and the work surface W. As with the previously discussed embodiment, shoes 106 are preferably welded to work surface W; however, any other known form of attachment is contemplated as within the scope of the invention. In both embodiments shown in FIGS. 1, 2, 5, 6, 7, 8, 9, and 10, the foot 8, 108 is preferably wider than base 10, 110 allowing for leverage and stability during clamping. Shoes 6, 106 are hollow and allow foot 8, 108 to slide in and out easily. The front portion of foot 8, 108 extending beyond the base 10, 110 holds the clamp 4, 104 down by virtue of holding member 34, 134 when clamping pressure is applied to a workpiece. Rear end 14, 114 of foot 8, 108 stops the clamp 4, 104 from leaning backwards when the clamp screw 24, 124 is tightened. Such clamping apparatus are easily employed when conventional clamps such as C-clamps cannot reach the center area of a work surface. In operation, such clamps 4, 104 may be slidingly disengaged from a shoe 6, 106 allowing workpieces, not shown, to be positioned on the work surface W. The clamps 4, 104 can then be slidingly engaged with the shoe 6, 106. The workpiece may then be clamped between the clamp head 26, 126 and the work surface W whereupon one or more welding operations may be performed thereon. Upon completion of the welding operation, the screw 24, 124 may be loosened and the clamp 4, 104 removed from the shoe 6, 106, allowing removal of the workpiece from the work surface W. This process can be repeated over and over again without the worry of lost time due to misalignment of clamps. Furthermore, the low profile of the shoe allows for easy and unrestricted removal of the finished parts, and provides for easy storage of work surface W. When the fabrication run is completed, if the configuration need not be saved, the welds at the front ends 42, 142 and rear ends 44, 144, 146, 46, can be ground and the shoe 6, 106 removed. In addition, shoes 6, 106 are reusable, and inexpensive to manufacture.

Figure 12:
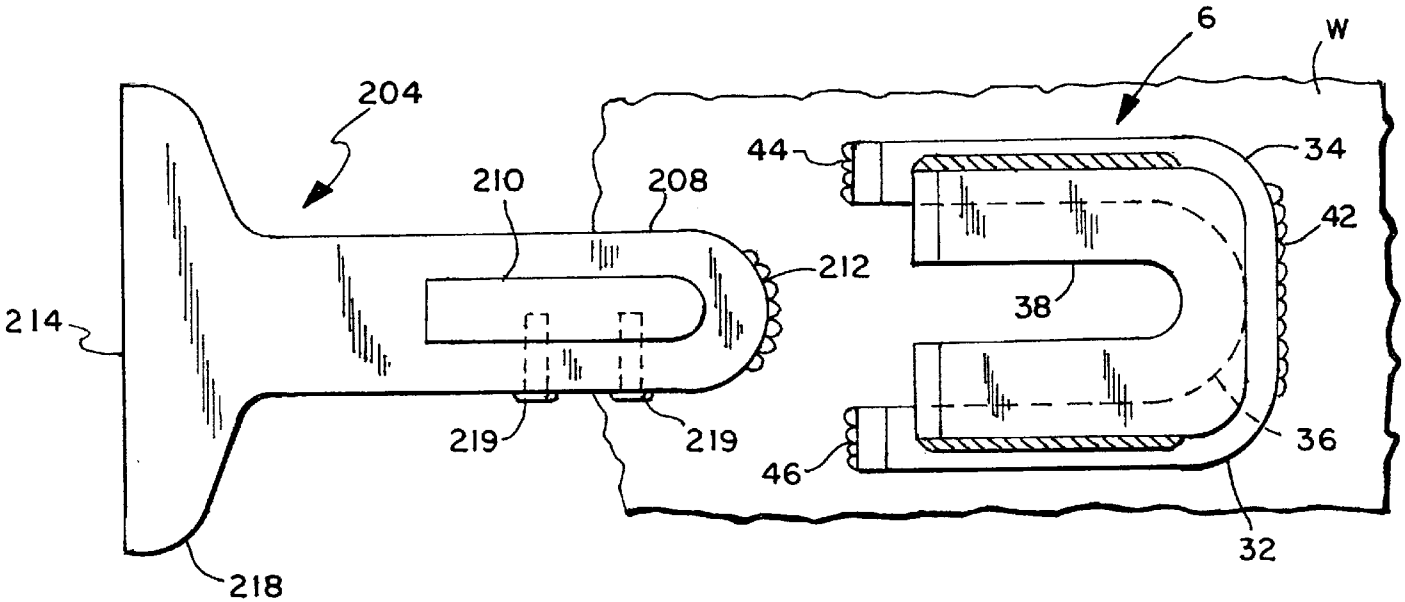
FIG. 12 is a plan view of the apparatus shown in FIG. 11.
Figure 11:
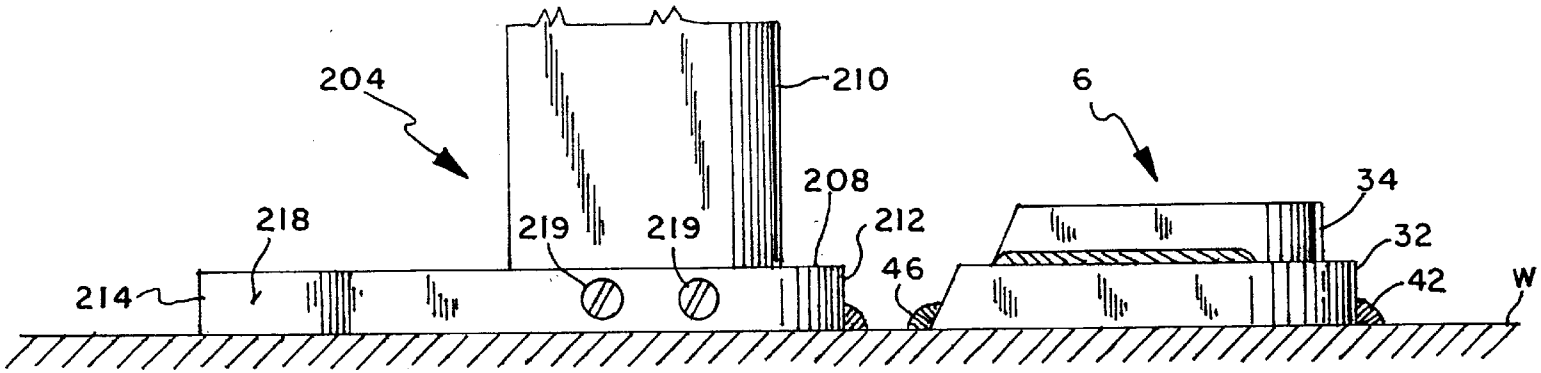
FIG. 11 is a partial side elevation view of another embodiment of a clamping apparatus in accordance with the present invention in which a foot is shown disengaged from a shoe.

As illustrated in FIGS. 11 and 12, for jobs requiring a one-time or low volume usage of a clamp, a foot clamp configuration can be achieved by positioning a clamp 204 on a work surface W, and subsequently welding a foot 208 to the work surface W at the front end 212. This allows for fast and easy location of the clamp 204. It will be further appreciated that in all the illustrated embodiments, shoes 6, 106, and alternatively foot 8, 108, and 208 may be welded directly to a workpiece that is being fabricated or repaired. Where a foot clamp configuration is employed, the clamp may be easily removed by retracting the screw 24, 124, and pushing forward on the base 210, thereby breaking the temporary weld at the front end 212 of the foot 208. The excess weld material can than be ground smooth allowing reuse of the clamp 204 in another foot clamp arrangement or in a shoe clamping configuration using a shoe 6, 106.

In the embodiment of FIGS. 11 and 12, a foot 208 may be provided with lateral support fins 218 at the rear end 214 of the foot 208, to further stabilize the clamp 204, particularly when used in a foot clamping configuration. Moreover, the foot 208 may be removably mounted to the base 210 of clamp 204 using clamping screws 219. This removable foot 208 allows use of the invention in both foot clamp or shoe clamp configurations in conjunction with the many commercially available clamps such as are known in the art. In this regard, the present invention may be used for ease and economy of positioning and repositioning clamps other than those specifically illustrated in the drawings, including, for example, clamps having a plurality of clamp heads, automatic or robotic clamps controlled by hydraulics or electronics, and the like. It will also be appreciated that different removably mountable feet 208 can be fabricated for attachment to different clamp bases 210. Furthermore, as the feet 8, 108, 208 and shoes 6, 106 of the current invention are simple, cost effective, and reusable, a user can easily keep many such parts in stock while needing a relatively small number of associated clamps. Whereas in the past, a welding fabricator or repair shop had to purchase the many clamps which were permanently mounted to special purpose fixtures, by use of the current invention, fixtures of comparable functionality, lower cost, lower weight and smaller storage profile may be made quickly and easily.

In the embodiment of FIGS. 13 and 14, a foot 308 may be provided containing a rear end 314 and a front end 312. The foot 308 includes a brace 316 that can be used for removably mounting to the base 310 of clamp 304 using clamping screws 319. This removable foot 308 in conjunction with the brace 316 allows use of the invention with the many commercially available clamps such as are known in the art. In this regard, the present invention may be used for ease and economy of positioning and repositioning clamps other than those specifically illustrated in the drawings, including, for example, clamps having a plurality of clamp heads, automatic or robotic clamps controlled by hydraulics or electronics, and the like. It will also be appreciated, as shown in FIG. 14, that brace 316 provides support to the front, rear, and sides of the base 310 of clamp 304. As displayed in FIGS. 13 and 14, clamping screws 319 are used for securing the base 310 to the brace 316 using the corresponding screw holes 320 in the base 310 and brace 316. FIGS. 13 and 14 also show the shoe 306 as a unitary structure. As such, the shoe 306 includes an inner slot 338 and a recess 336. The outside wall 332 of the shoe 306 is shown welded to the work surface W at front end 42 and rear ends 44, 46, respectively. With shoe 306 thus mounted on the work surface W, the clamp 304 may be slidingly engaged with the shoe 306 in a direction shown by arrow 48 until one or both of front ends 312 and/or 317 engage with the closed ends of recess 336 and/or inner slot 338, respectively.

Figure 15:
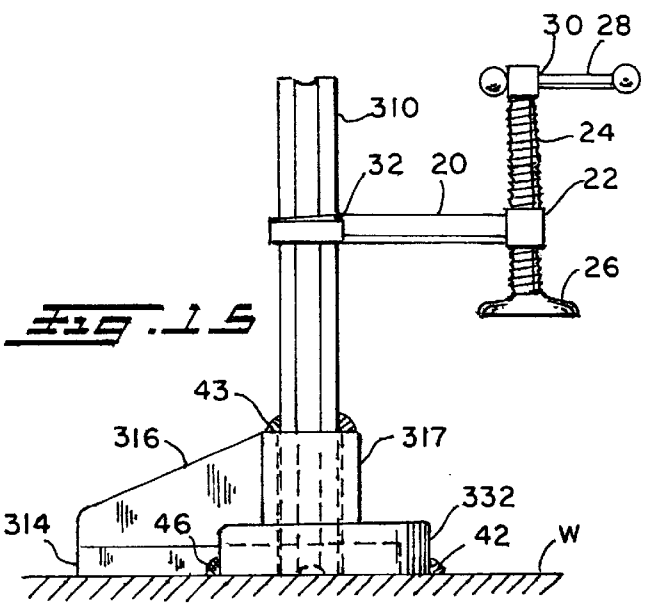
FIG. 15 is a side elevation view of another embodiment of a clamping apparatus in accordance with the present invention shown with a clamp and a shoe engaged.

FIG. 15 illustrates another embodiment of securing base 310 to brace 316 by welding at position 43 subsequent to mounting base 310 into brace 316. This embodiment provides a quick and easy method for securing the base 310 to the brace 316 without the requirement of clamping screws 319.

As many possible embodiments of the present invention may be made, and as many possible changes may be made in the embodiment set forth herein, it is to be distinctly understood that the foregoing descriptive matter is to be interpreted merely as an illustration of specific embodiments of the invention, and not as a limitation thereof. It is therefore applicant's intent to include all embodiments within the scope of the accompanying claims and all equivalents thereof.

Having thus described the invention, it is claimed:

1. An apparatus for clamping a workpiece in a fixed location with respect to a work surface during a welding operation comprising: a clamp with a foot removably engaging a shoe, said shoe being mounted on said work surface; said shoe includes: a U-shaped positioning member; a U-shaped holding member mounted on top of said positioning member; said positioning member having a recess for interengaging said foot of said clamp, said clamp having a vertical base; and, said holding member having an inner slot for receiving front end of said base.

2. An apparatus for clamping a workpiece in a fixed location with respect to a work surface during a welding operation comprising: a clamp with a foot removably engaging a shoe, said shoe being mounted on said work surface, said shoe comprises a U-shaped outer wall partially surrounding a recess having a width, said U-shaped outer wall having an inwardly extending flange defining an inner slot having a width less than said recess width, said foot having a width greater than said inner slot width.

3. The apparatus as defined in claim 1, wherein said clamp includes: an arm for coarse adjustment of vertical height of a clamping head; and a screw connected to a handle for fine adjustment of said vertical height of said clamping head.

4. The apparatus as defined in claim 1, wherein said vertical base extends upwardly and outwardly from said foot for positioning of a clamp head.

5. The apparatus as defined in claim 1, wherein said clamp includes: a brace providing support to said vertical base.

6. The apparatus as defined in claim 5, wherein said foot is removably mountable to said vertical base of said clamp.

7. The apparatus as defined in claim 5, wherein said vertical base corresponds to the shape of an inner slot formed by a U-shaped holding member.

8. The apparatus as defined in claim 5, wherein said foot corresponds to the shape of a recess formed by a U-shaped positioning member and a U-shaped holding member.

9. The apparatus as defined in claim 1, wherein said shoe includes a low profile.

10. The apparatus as defined in claim 1, wherein said U-shaped holding member comprises a holding member first side wall, a holding member second side wall and a holding member front wall; said holding member first side wall, said holding member second side wall, and said holding member front wall have a flange on the inward side.

11. The apparatus as defined in claim 10, wherein a positioning member first side wall, a positioning member second side wall, a positioning member front wall, and said flange form said recess below said inner slot; said recess having greater dimensions than said inner slot.

12. The apparatus as defined in claim 11, wherein said foot includes a front end for interengaging with closed end of said recess; said foot supports said vertical base; and, said vertical base includes a font end for interengaging with closed end of said inner slot.

13. The apparatus as defined in claim 1, wherein said U-shaped positioning member and said U-shaped holding member are a unitary structure.

14. The apparatus as defined in claim 13, wherein the outward wall of said positioning member contains a weldable surface.

15. The apparatus as defined in claim 1, wherein said positioning member and said holding member have varying sizes.

16. An apparatus for clamping a workpiece in a fixed location with respect to a work surface during a welding operation comprising:

a clamp with a base having a generally uniform cross-sectional area;

said base cross-sectional area having a base cross-sectional length and a base cross-sectional width;

said base including a foot at one end;

said foot having a generally planar bottom surface;

said bottom surface having a length greater than said base cross-sectional length and a width greater than said base cross-sectional width;

a shoe removably welded on said work surface;

said shoe having a U-shaped slotted inner recess open on at least one side;

said shoe includes a U-shaped flange surrounding said recess;

said recess and said flange define an opening for slidably receiving said base and said foot, whereupon engagement of said shoe to said foot, said clamp is secured to said work surface.

17. An apparatus for clamping a workpiece in a fixed location with respect to a work surface during a welding operation comprising:

at least one clamp with a base having a generally uniform cross-sectional area;

said base cross-sectional area having a base cross-sectional length and a base cross-sectional width;

said base including a foot at one end;

said foot having a generally planar bottom surface;

said bottom surface having a length greater than said base cross-sectional length and a width greater than said base cross-sectional width;

at least one shoe removably welded on said work surface;

said at least one shoe having a U-shaped slotted inner recess open on at least one side;

said at least one shoe includes a U-shaped flange surrounding said recess;

said recess and said flange define an open for slidably receiving said base and said foot, whereupon engagement of said at least one shoe to said foot, said at least one clamp is secured to said work surface.

18. An apparatus for clamping at least one workpiece in at least one fixed location with respect to a work surface during at least one welding operation comprising:

at least one clamp with a base having a generally uniform cross-sectional area;

said base cross-sectional area having a base cross-sectional length and a base cross-sectional width;

said base including a foot at one end;

said foot having a generally planar bottom surface;

said bottom surface having a length greater than said base cross-sectional length and a width greater tan said base cross-sectional width;

at least one shoe removably welded on said work surface;

said at least one shoe having a U-shaped slotted inner recess open on at least one side;

said at least one shoe includes a U-shaped flange surrounding said recess;

said recess and said flange define an opening for slidably receiving said base and said foot, whereupon engagement of said at least one shoe to said foot, said at least one clamp is secured to said work surface.

19. An apparatus for clamping a workpiece in a fixed location with respect to a work surface during a welding operation comprising:

a clamp terminating in a foot, said foot moveable relative to said work surface, said foot including means for engaging a shoe, said shoe being tack welded on said work surface, whereby upon engagement of said shoe to said foot, said clamp is secured to said work surface, and whereby said tack welds may be ground thereby breaking said tack welds and releasing said shoe from said work surface;

said shoe being reusable.

20. An apparatus for clamping a workpiece in a fixed location with respect to a work surface during a welding operation comprising:

a clamp having a base with a base cross-sectional length and a base cross-sectional width, said base terminating in a foot, said foot having a generally planar bottom surface, a foot length greater than said base cross-sectional length and a foot width greater than said base cross-sectional width, said foot having a forward edge, and a rearward edge, said foot being tack welded along said forward edge on said work surface, said clamp includes an adjustment of said vertical height of said clamping head, said workpiece is clamped in a fixed location proximal to said forward edge, said clamp having a first axis of rotation coincident with an axis of contact between said forward edge of said foot and said work surface proximal to said workpiece, said clamp having a second axis of rotation coincident with an axis of contact between said rearward edge of said foot and said work surface distal to said workpiece, said clamp resists rotation about said second axis of rotation when said clamping head is tightened against said workpiece, and said clamp being manually rotatable toward said workpiece about said first axis of rotation thereby breaking said tack weld and releasing said foot from said work surface.

21. The apparatus as defined in claim 20, wherein said base extends upwardly and outwardly from said foot for supporting of a clamping head at another end.

22. The apparatus as defined in claim 20, whereby said tack weld may be ground from said work surface upon removal of said clamp from said work surface.

* * * * *